US011492857B2

(12) United States Patent
Webb et al.

(10) Patent No.: US 11,492,857 B2
(45) Date of Patent: Nov. 8, 2022

(54) TORQUE DEVICE FOR OIL FIELD USE AND METHOD OF OPERATION FOR SAME

(71) Applicant: National Oilwell Varco Norway AS, Kristiansand S (NO)

(72) Inventors: Jonathan Garrick Webb, Kristiansand S (NO); David Allen Hill, Kristiansand S (NO); Trond Werner Moen, Kristiansand S (NO)

(73) Assignee: NATIONAL OILWELL VARCO NORWAY AS, Kristiansand S (NO)

( * ) Notice: Subject to any disclaimer, the term of this patent is extended or adjusted under 35 U.S.C. 154(b) by 528 days.

(21) Appl. No.: 16/714,641

(22) Filed: Dec. 13, 2019

(65) Prior Publication Data

US 2020/0115971 A1 Apr. 16, 2020

Related U.S. Application Data

(63) Continuation of application No. 14/241,161, filed as application No. PCT/NO2012/050169 on Sep. 5, 2012, now Pat. No. 10,550,651.

(Continued)

(51) Int. Cl.
*E21B 19/16* (2006.01)

(52) U.S. Cl.
CPC ..... *E21B 19/163* (2013.01); *E21B 19/165* (2013.01); *Y10T 29/4984* (2015.01)

(58) Field of Classification Search
CPC ... E21B 19/163; E21B 19/165; Y10T 29/4984
See application file for complete search history.

(56) References Cited

U.S. PATENT DOCUMENTS 5,259,275 A 11/1993 Schulze-Beckinghausen
5,390,568 A 2/1995 Pietras (Continued)

FOREIGN PATENT DOCUMENTS

JP 2011247073 A * 12/2011 ..... E04G 21/12
WO 90/06418 A1 6/1990
WO 92/18743 A1 10/1992

OTHER PUBLICATIONS

PCT/NO2012/050169 International Search Report and Written Opinion dated Aug. 6, 2013 (10 p.).

(Continued)

*Primary Examiner* — David B. Thomas
(74) *Attorney, Agent, or Firm* — Conley Rose, P.C.

(57) ABSTRACT

A torque device for guiding a first torque device member relative to a second torque device member includes the first and second torque device members. Each of the torque device members has an operational axis of rotation and three clamp bodies spaced about the operational axis. The clamp bodies are movable between a retracted passive position and an extended active position. The torque device also includes a guide ring on one of the torque device members. The guide ring includes one or more guide ring sections. In addition, the torque device includes at least two guide elements on the other of the torque device members. Each guide element being movable with one of the clamp bodies of the respective torque device member. When the clamp bodies of the respective torque device member are in their retracted positions, the guide elements abut or are close to the guide ring, and when the clamp bodies of the respective torque device member are in their extended positions, the guide elements are moved away from the guide ring.

17 Claims, 16 Drawing Sheets

Related U.S. Application Data

(60) Provisional application No. 61/532,770, filed on Sep. 9, 2011.

(56) References Cited

U.S. PATENT DOCUMENTS

| | | | | |
|---|---|---|---|---|
| 6,047,775 | A | 4/2000 | Mock | |
| 7,062,991 | B1 | 6/2006 | West et al. | |
| 7,188,547 | B1 | 3/2007 | West et al. | |
| 7,958,787 | B2 * | 6/2011 | Hunter | E21B 19/163 73/862.21 |
| 10,808,469 | B2 * | 10/2020 | Vo | E21B 19/163 |

OTHER PUBLICATIONS

Office Action dated Feb. 13, 2017, for U.S. Appl. No. 14/241,161 (9 p.).
Response to Office Action dated Feb. 13, 2017, for U.S. Appl. No. 14/241,161; Response filed May 15, 2017 (12 p.).
Final Office Action dated Aug. 10, 2017, for U.S. Appl. No. 14/241,161 (8 p.).
Response to Final Office Action dated Aug. 10, 2017, for U.S. Appl. No. 14/241,161; Response filed Jan. 2, 2018 (14 p.).
Advisory Action dated Jan. 29, 2018, for U.S. Appl. No. 14/241,161 (8 p.).
RCE and Response to Final Office Action dated Aug. 10, 2017, for U.S. Appl. No. 14/241,161; Response filed Mar. 28, 2018 (21 p.).
Office Action dated Jun. 29, 2018, for U.S. Appl. No. 14/241,161 (8 p.).
Response to Office Action dated Jun. 29, 2018, for U.S. Appl. No. 14/241,161; Response filed Oct. 1, 2018 (16 p.).
Final Office Action dated Jan. 23, 2019, for U.S. Appl. No. 14/241,161 (11 p.).
Response to Final Office Action dated Jan. 23, 2019, for U.S. Appl. No. 14/241,161; Response filed Mar. 25, 2019 (15 p.).
Advisory Action dated Apr. 8, 2019, for U.S. Appl. No. 14/241,161 (3 p.).
Notice of Appeal dated Apr. 22, 2019, for U.S. Appl. No. 14/241,161 (2 p.).
Appeal Brief dated Jun. 19, 2019, for U.S. Appl. No. 14/241,161 (34 p.).
Notice of Allowance dated Sep. 16, 2019, for U.S. Appl. No. 14/241,161 (9 p.).

* cited by examiner

II–II

X–X

TORQUE DEVICE FOR OIL FIELD USE AND METHOD OF OPERATION FOR SAME

CROSS-REFERENCE TO RELATED APPLICATIONS

This application is a continuation of U.S. application Ser. No. 14/241,161 filed May 30, 2014, and entitled "A Torque Device for Oil Field Use and Method of Operation for Same," which is a 35 U.S.C. § 371 national stage application of PCT/NO2012/050169 filed Sep. 5, 2012 and entitled "A Torque Device for Oil Field Use and Method of Operation for Same," which claims priority to U.S. Provisional Application No. 61/532,770 filed Sep. 9, 2011 and entitled "Powered Torque Device," each of which are hereby incorporated herein by reference in their entirety for all purposes.

FIELD OF INVENTION

There is provided a torque device for oil field use and method of operation for same. More precisely there is provided a torque device for oil field use and method of operation for same where the torque device includes a first torque device member that has an operational axis of rotation, and where a first torque actuator is pivotally connected to the first torque device member at a first radial distance from a centre line of the first torque device member. There is also provided a method for operation of a torque device for oil field use.

In this document that is related to onshore and offshore oilfield equipment and methods, the word pipe is used to describe elongate elements in general. Depending on the operation in question the elongate element may be a tubular or nontubular, a tool or any related item that is associated with a tool joint.

BACKGROUND OF THE INVENTION

A typical powered torque device used for making up or breaking out pipe connections in oilfield-related applications includes a pair of torque device members, here termed "first torque device member" and "second torque device member", but often referred to as "power tong" and "backup tong." In use, the power tong rotates a first pipe relative to a second pipe while the backup tong holds the second pipe relatively stationary. Each of these tongs has a slot for receiving its respective pipe. Typically, each of these tongs has a set of clamp bodies that normally includes clamp dies for engaging the pipe when the pipe is received in the tong slot.

In some powered torque devices, the torque applied to the first pipe by the power tong is derived from a pair of push-pull hydraulic actuators. These powered torque devices typically impose significant shear loads on the pipe connection as a result of inherent push-pull force imbalance of the push-pull hydraulic actuators and eccentricity of the backup and power tongs induced by tong clamping error. These shear loads can contribute to improper make-up of pipe connections. In these powered torque devices, lateral loads on the threads of the pipe connection can change the friction in the pipe connection and cause some degree of torque masking. Here, the term "torque masking" refers to anything that causes the torque reading from the powered torque device to deviate from the actual torque experienced by the pipe connection.

In some powered torque devices, mechanical guiding is used between the backup and power tongs to ensure that the backup tong and power tong have a common pipe rotation axis while the power tong is rotating. The guiding typically takes the form of a system of guide rings concentric to a theoretical pipe axis and arranged between the backup tong and the power tong and/or between the power tong and an outer structure. The current-art guide system will typically work during torque application when both the backup and power tongs are clamped to the pipes and during non-torque rotation when the power tong is not clamped to a pipe. In these powered torque devices, clamp center deviation between the power and backup tongs can cause torque masking. Specifically, if the clamped center deviation exceeds the guide ring clearance, some portion of the clamping force will be transferred onto the guide ring surfaces. The resulting friction during rotation of the power tong will then function as a drum brake leading to an apparent torque larger than the actual torque.

Errors in torque reading can make it difficult to make-up pipe connections with accuracy, particularly in applications where pipe connections are to be made up with torque in a narrow torque bandwidth.

The object of the invention is to remedy or reduce at least one of the disadvantages of the prior art.

The object is achieved according to the invention by virtue of the features disclosed in the description below and in the subsequent claims.

SUMMARY

According to a first aspect of the invention there is provided a torque device for oil field use that includes a first torque device member that has an operational axis of rotation, and where a first torque actuator is pivotally connected to the first torque device member at a first radial distance from a centre line of the first torque device member, wherein a rod or a second torque actuator is pivotally connected to the first torque device member at a second radial distance extending in the opposite direction relative the first radial distance from the centre line, and where the first torque actuator is pivotally connected to a first portion of an actuator support, and where the rod, alternatively the second torque actuator, is pivotally connected to a second portion of the actuator support, and where the actuator support is radially movable relative the operational axis, but is restricted from rotating in a plane that is perpendicular to the operational axis.

The suspension of the torque device renders the first torque device member substantially free to slide in a plane perpendicular to the operational axis.

When attached to a pipe that is fixed in the radial direction, the operational axis coincides with a length axis of the pipe. The first torque device member turns with the pipe. If the torque device is equipped with the first torque actuator and the rod, the actuator support may, while the first torque device member pivots with the pipe, move towards or away from the operational axis.

If the torque device has the first torque actuator and the second torque actuator where one extends while the other contract at about equal speeds during pivoting of the first torque device member, the actuator support may be substantially stationary. Any discrepancy in speed between the two torque actuators results in a movement of the actuator support towards or away from the operational axis.

The actuators may be of any useful form such as hydraulic, pneumatic and electric.

The first torque actuator and the rod, alternatively the second torque actuator, may at the first portion respective the second portion of the actuator support be pivotally connected to the actuator support about an support axis that joins the first portion and the second portion.

Although only minor movements of the first torque device member are envisaged along the operational axis, the torque actuators and the rod are thus free to tilt about the support axis that joins the first portion and the second portion.

The first torque device member may be connected to a second torque device member sharing the operational axis. The first torque device member may be a power tong while the second torque device member may be a backup tong.

The actuator support may be connected to the second torque device member.

The actuator support may be pivotally connected to the second torque device member about a pivot axis that has a direction to let the actuator support be pivotable to and from the operational axis.

The two torque device member may thus be operational as a pair, as the second torque device member forms a base for the actuator support and thus for the first torque device member.

The first torque actuator may be connected to a torque device member body of the first torque member by a first actuator fixture.

The rod, alternatively the second torque actuator, may be connected to a torque device member body of the first torque member by a second actuator fixture.

The length of the actuator fixtures has to be adapted to the length of the actuators and to the length between the first and second portion of the actuator support.

The first portion and the second portion of the actuator support may be positioned at the same height in the direction of the operational axis.

The first torque actuator may, at least over some of its working range, be parallel with the rod, alternatively with the second torque actuator.

According to a second aspect of the invention there is provided a method of operation of a torque device for oil field use that includes a first torque device member that has an operational axis of rotation, and where a first torque actuator is pivotally connected to the first torque device member at a first radial distance from a centre line of the first torque device member, wherein the method further includes:

- connecting a rod or a second torque actuator to the first torque device member at a second radial distance that extends in the opposite direction relative the first radial distance from the centre line;
- pivotally connecting the first torque actuator to a first portion of the actuator support;
- pivotally connecting the rod, alternatively the second torque actuator, to a second portion of the actuator support; and
- letting the actuator support move radially relative the operational axis, but restricting the actuator support from rotating in a plane that is perpendicular to the operational axis.

The method may further include pivotally connecting the first torque actuator at the first portion of the actuator support, and the rod, alternatively the second torque actuator, to the second portion of the actuator support about a support axis that join the first portion and the second portion.

The method may further include connecting the first torque device member to a second torque device member that shares the operational axis.

The method may further include connecting the actuator support to the second torque device member.

The method may further include pivotally connecting the actuator support to the second torque device member about a pivot axis that has a direction to let the actuator support be pivotable to and from the operational axis.

The method may further include positioning the first portion and the second portion of the actuator support at the same height relatively the operational axis.

The device and method according to the invention render it possible to torque the first pipe without inducing lateral forces. Lateral forces as induces by prior art tools due to their laterally fixed connections, tend to set up additional friction forces in threads, thus masking or disturbing torque readings for threaded tool joint connection.

BRIEF DESCRIPTION OF THE DRAWINGS

Below, an example of a preferred device and method is explained under reference to the enclosed drawings, where.

DETAILED DESCRIPTION OF THE INVENTION

Figure 1:
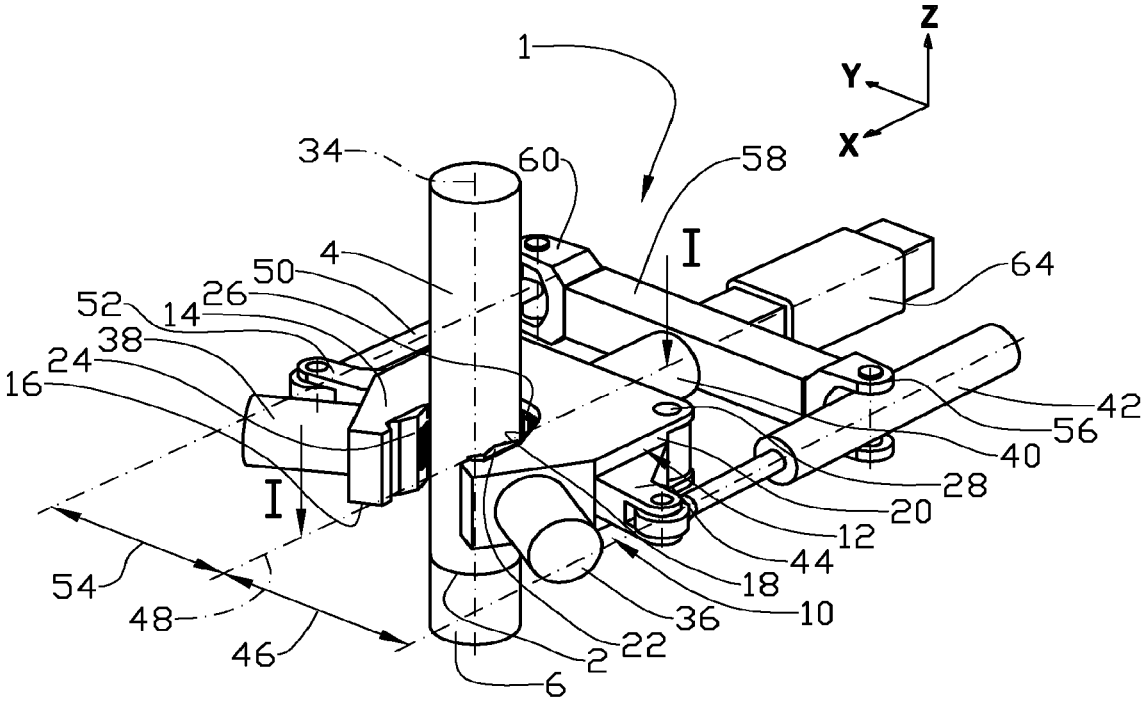
FIG. 1 shows a perspective view of a torque device according to the invention.

It should be noted that the figures, in order to better disclose the inventive features, generally only show features necessary for the disclosure. This implies that a number of necessary items such as fixings, power supplies, control cables and equipment are not shown. These items and their function are however known to a skilled person.

In the figures the reference number 1 denotes a powered torque device for making up or breaking out a connection tool joint 2 between a first pipe 4 and a second pipe 6. The torque device 1, see FIG. 1, includes a first torque device member 10 that has a torque device member body 12.

The torque device member body 12 is in this embodiment made up of an upper part 14 and a lower part 16 where both parts 14, 16 have "U" formed slots 18 for placing the first pipe 4. The upper and lower parts 14, 16 are spaced apart and joined by side parts 20. Upper and lower refer to operational positions of the torque device 1.

The first torque device member 10 has three clamp bodies 22, 24, 26 that are designed to move between a retracted passive position, wherein the clamp bodies 22, 24, 26 are disengaged from the first pipe 4, and an active extended position, wherein the clamp bodies 22, 24, 26 are in contact with the first pipe 4. Of these clamp bodies 22, 24, 26, the first clamp body 22 includes a clamp arm extension 27 that hinges on a first clamp pin 28, see FIG. 2, the second clamp body 24 includes a clamp arm extension 29 that hinges on a second clamp pin 30, while the third clamp body 26 is linearly movable in a guide 32, see FIG. 3. The clamp pins 28, 30 are in this embodiment fixed to the torque device member body 12.

A coordinate XYZ system is shown in FIG. 1. The Z-axis is orthogonal to the XY plane. The torque device 1 has an operational axis of rotation 34 that extends in the Z direction. The operational axis 34 normally coincides with a centre axis of the first pipe 4 when the torque device 1 is clamped on to the first pipe 4.

The first torque device member body 12, that is supported by a structure not shown, is substantially free to slide, or slidable in the XY plane.

Figure 2:
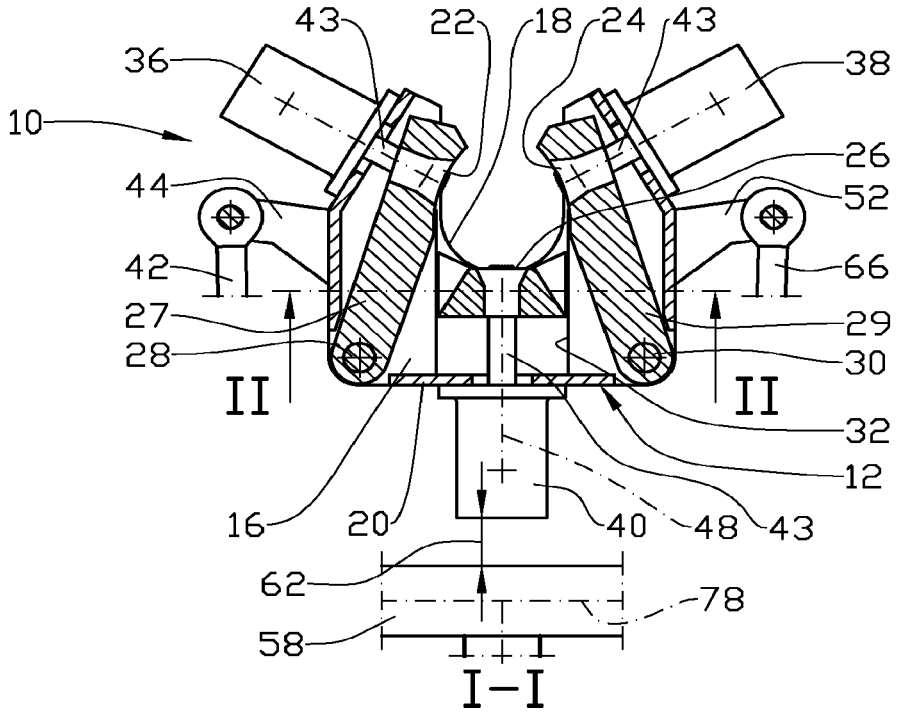
FIG. 2 shows a section I-I in FIG. 1.
Figure 3:
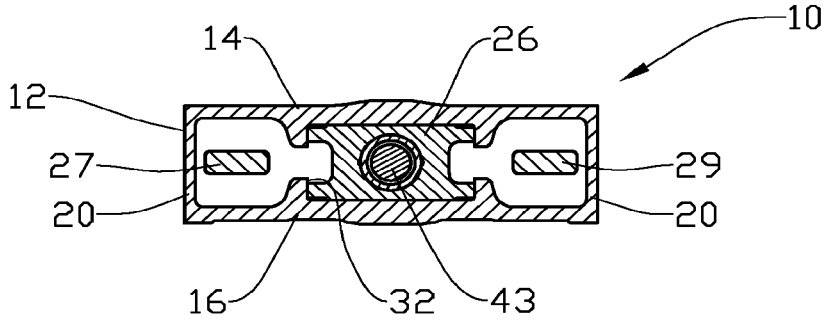
FIG. 3 shows a section II-II in FIG. 2.

When viewed from the opposite side relative to the "U" formed slot 18, see FIG. 2, the first clamp body 22 is positioned on the left hand side of the operational axis 34, the second clamp body 24 is positioned on the right hand side of the operational axis 34, while the third clamp body 26 is positioned between the first and second clamp bodies 22, 24. The clamp bodies 22, 24, 26 are here movable inside the torque device member body 12 in a plane parallel to the XY plane.

The first, second and third clamp bodies 22, 24, 26 are coupled to and moved by a first clamp actuator 36, a second clamp actuator 38 and a third clamp actuator 40 respectively. The clamp actuators 36, 38, 40 are fitted to the side part 20 of the torque device member body 12 and are connected to their respective clamp bodies 22, 24, 26 by intermediate struts 43.

A first torque actuator 42 is pivotally connected to the first torque device member 10 at a first actuator fixture 44 and at a first radial distance 46 from a centre line 48 of the first torque device member 10. When the first torque device member 10 is at its mid position, the centre line 48 is parallel with the X direction. A rod 50 is pivotally connected to the first torque device member 10 at a second actuator fixture 52 at a second radial distance 54 from the centre line 48. The first and second radial distances 46, 54 are on opposite sides relative the centre line 48. The connections of the first torque actuator 42 and the rod 50 at the first actuator fixture 44 and the second actuator fixture 52 respectively may be in the form of ball type connections as often used on actuators.

The first actuator 42 is also pivotally connected to a first portion 56 of an actuator support 58, while the rod 50 is pivotally connected to a second portion 60 of the actuator support 58. The first and second portions 56, 60 of the actuator support 58 are here fork formed.

As shown inn FIG. 2 there is a variable clearance 62 between the third clamp actuator 40 and the actuator support 58.

The actuator support 58 is movable in the X direction which is the radial direction relative the operational axis 34 of the first torque device member 10. The actuator support 58 is however restrained from rotating in the XY plane that is perpendicular to the operational axis 34.

In FIG. 1 the actuator support 58 is shown movable in a guide member 64 that is fixed to a structure not shown.

During normal operations the centre line 48 is perpendicular to the operational axis 34. Due to a possible imperfect clamping position of the first pipe 4 relative the first torque device member 10, the operational axis 34 may or may not intercept the centre line 48.

When a torque is to be applied to the first pipe 4, the first pipe 4 is positioned in the "U"-formed slot 18 of the first torque device member 10. The clamp bodies 22, 24, 26 are moved by their respective clamp actuators 36, 38, 40 to their active positions engaging the first pipe 4. As the first torque device member 10, prior to being clamped to the first pipe 4, apart from being connected to the first torque actuator 42 and the rod 50, is free to move in the XY plane, the first torque device member 10 will, when the clamp bodies 22, 24, 26 engage the first pipe 4, position itself on first pipe 4, the centre axis of the first pipe 4 thus becoming the operational axis 34 of the torque device 1.

In the embodiment shown in FIG. 1 the second pipe 6 is fixed to a structure not shown at least in the directions perpendicular to the operational axis 34. As the first actuator 42 extends or retracts, a torque is set up in the first pipe 4 about the operational axis 34. The actuator support 58 is moved by the rod 50 in the X direction, which is in the radial direction relative the operational axis 34, thus setting up a torque in the first pipe 4 without inducing radial forces in the first pipe 4 in the XY plane.

Figure 4:
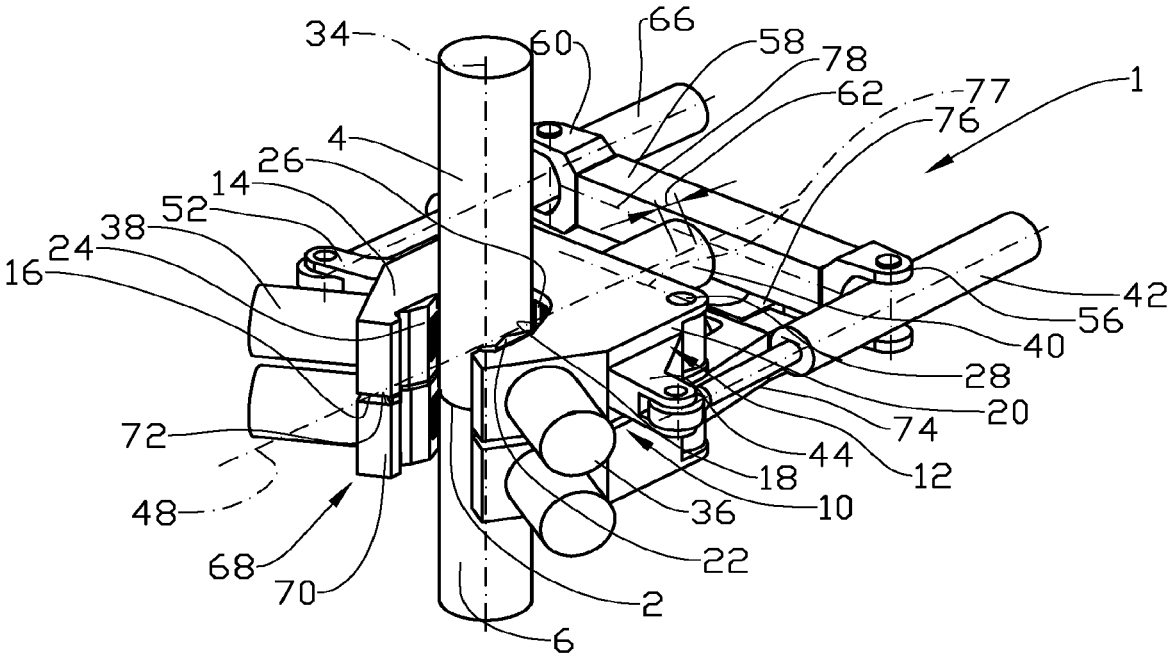
FIG. 4 shows a perspective view of a torque device in a different embodiment.

In an alternative embodiment, the rod 50 may be exchanged for a second torque actuator 66 as shown in FIG. 4.

As shown in FIG. 4, the torque device 1 includes the first torque device member 10 and a second torque device member 68 that is positioned below the first torque device member 10.

The second torque device member 68 is similar in design to the first torque device member 10 and includes a torque device member body 70 with an upper part 72.

A yoke 74 extends in the X direction from the second torque device member 68 and to below the actuator support 58. The actuator support 58 is connected to the yoke 74 via a pivot bearing 76 that pivots about a pivot axis 77 that is parallel to the Y direction. The actuator support 58 may pivot freely in the pivot bearing 76 to move in the radial direction to and from the first torque device member 10, see FIGS. 10 and 11, where the first torque device member 10 and the torque actuators 42, 66 are not shown.

In the embodiment shown in FIG. 4, the first portion 56 and the second portion 60 of the actuator support 58 are pivotally connected to the actuator support 58 and may pivot about a support axis 78 that extends between the first and second portions 56, 60. The support axis 78 is parallel with the Y direction. The first and second portions 56, 60 are thus free to pivot about the support axis 78 when the actuator support 58 pivots on the pivot bearing 76. The first and second portions 56, 60 may alternatively be formed as cardan or gimbal connections not shown.

If the torque device 1 is to be used for making up the tool joint 2, see FIGS. 1 and 4, the second torque device member 68 is clamped to the second pipe 6, and the first torque device member 10 is clamped to the first pipe 4. If the first actuator 42 extends at the same rate as the second torque actuator 66 retracts, the actuator support 58 will remain stationary while applying torque to the tool joint 2. Any discrepancy in the rate of movement between the two torque actuators 42, 66 will result in a movement of the actuator support 58 in the guide member 64, respectively about the pivot bearing 76 and pivot axis 77. Thus the actuator support 58 is movable to prevent radial forces from being applied to pipes 4, 6, allowing only torque to be applied to the pipes 4, 6.

Figure 5:
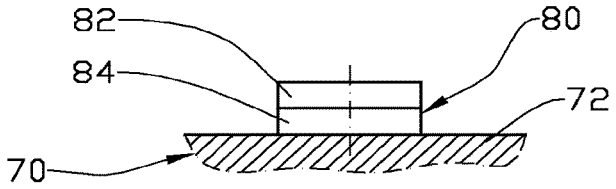
FIG. 5 shows a side view of a support pad.

FIG. 5 shows a support pad 80 which is intended to allow the upper first torque device member 10 to slide freely relative to the lower second torque device member 68, as well as to allow the first and second torque device members 10, 68 to move towards each other a physical distance as the pipes 4, 6 are screwed together through the rotation angle of the upper first torque device member 10.

The support pad 80 includes a top layer 82 and a bottom layer 84. The top layer 82 may be laminated to the bottom layer 84 by any suitable means such as, but not limited to, bonding. The support pad 80 may have a disc shape. The top layer 82 is the layer that is in contact with the first torque device member 10. The top layer 82 is made of a low-friction, wear-resistant material, which would allow the first torque device member 10 to slide freely relative to the second torque device member 68. The bottom layer 84 is the layer that is in contact with the upper part 72 of the second torque device member body 70.

The bottom layer 84 is made of a compressible, spring material that allows a small amount of compression without permanent deformation in order to sustain a relative movement along the operational axis 34 between the first torque device member 10 and the second torque device member 68. The material of the bottom layer 84 is compressed against the second torque device member 68 by the weight of the first torque device member 10 and by the first torque device member 10 moving a physical distance, not shown, while being rotated through a rotation angle to make-up a connection tool joint 2. The compressibility of the material of the bottom layer 84 is chosen to support the first torque device member 10 a sufficient distance above the second torque device member 68 and to allow sufficient movement of the first torque device member 10 along the operational axis 34 while making up a connection tool joint 2, thereby preventing other physical contact between the first torque device member 10 and the second torque device member 68.

Figure 6:
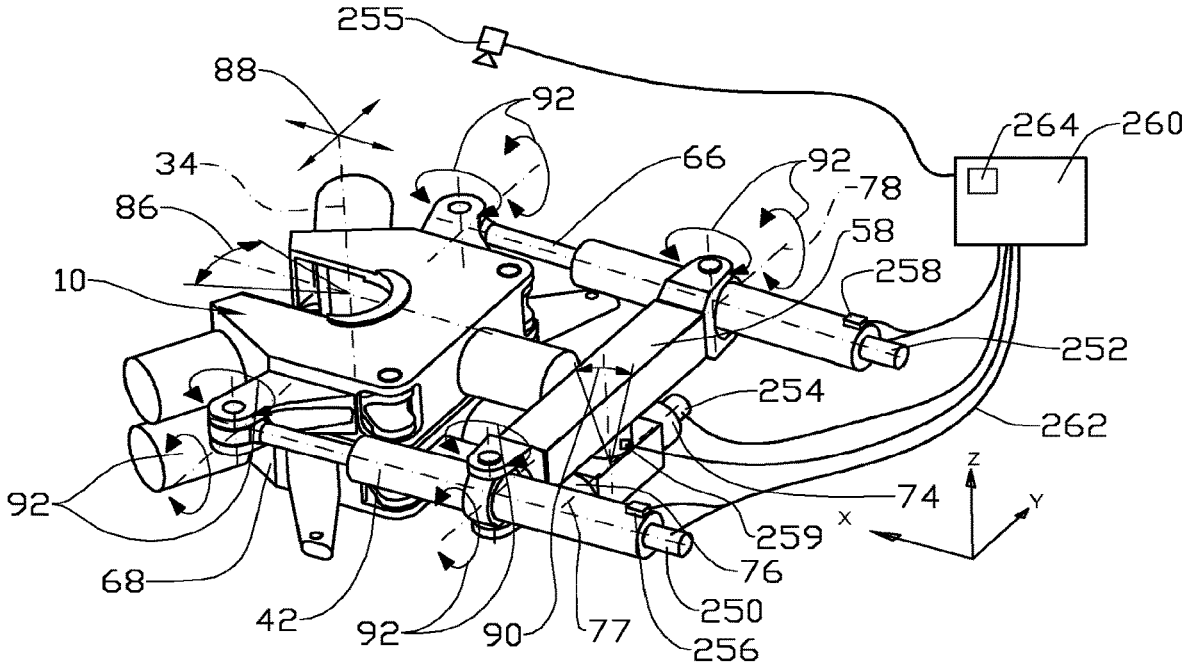
FIG. 6 shows a perspective view of the torque device in FIG. 4 where different degrees of freedom are indicated.

Possible movements of the first torque device member 10 are indicated in FIG. 6. An arrow shows the rotational position 86 of the first torque device member 10 about the operational axis 34, arrows show the possible movements 88 of the first torque device member 10 in the XY plane, arrows show the possible actuator support movement 90 of the actuator support 58 about the pivot axis 77. Arrows show torque actuators 42, 66 pivot movements 92 at their respective connections.

Figure 7:
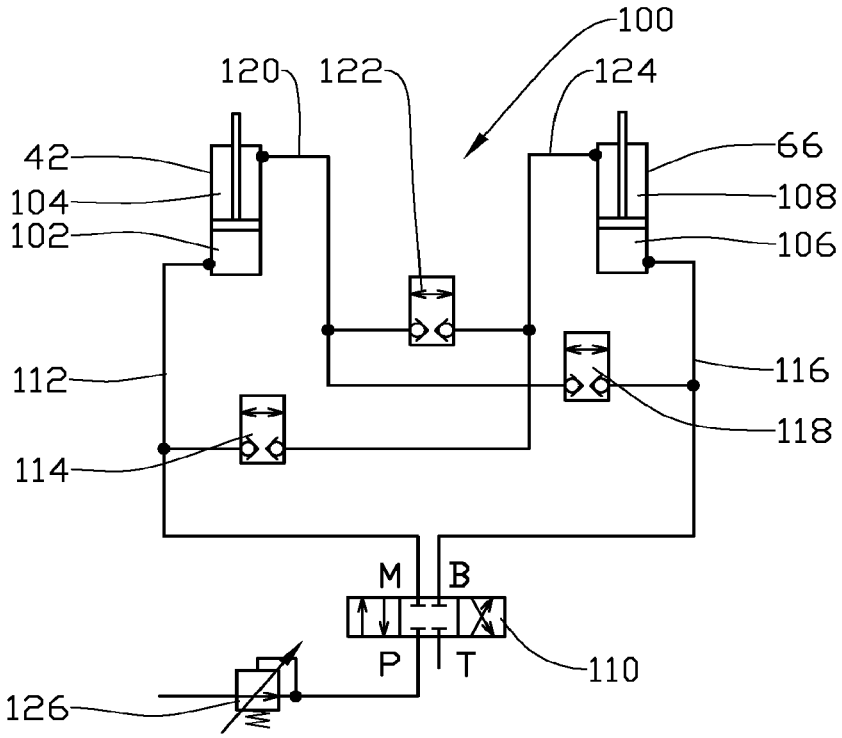
FIG. 7 shows a hydraulic control circuit for the torque device.

The torque device 1 may be controlled by a power circuit 100 as shown in FIG. 7. The first torque actuator 42 shown in FIG. 7 has a first plus chamber 102 and a first minus chamber 104. The second torque actuator 66 has a second plus chamber 106 and a second minus chamber 108.

When hydraulic fluid is supplied to the plus chambers 102, 106, the respective torque actuators 42, 66 extend, while they retract if hydraulic fluid is supplied to the minus chambers 104, 108.

Pressurized hydraulic fluid is in the normal way supplied to the pump port P (P port) of a direction valve 110, and hydraulic fluid is drained from the direction valve 110 through a drainage port T (T port). A first plus line 112 connects a make port M (M port) on the direction valve 110 to the first plus chamber 102 and to a first closable valve 114. A second plus line 116 connects a break port B (B port) of the direction valve 110 to the second plus chamber 106 and to a second closable valve 118. A first minus line 120 connects the first minus chamber 104 with a third closable valve 122 and the second closable valve 118. A second minus line 124 connects the second minus chamber 108 with the first and third closable valves 114, 122.

Figure 8:
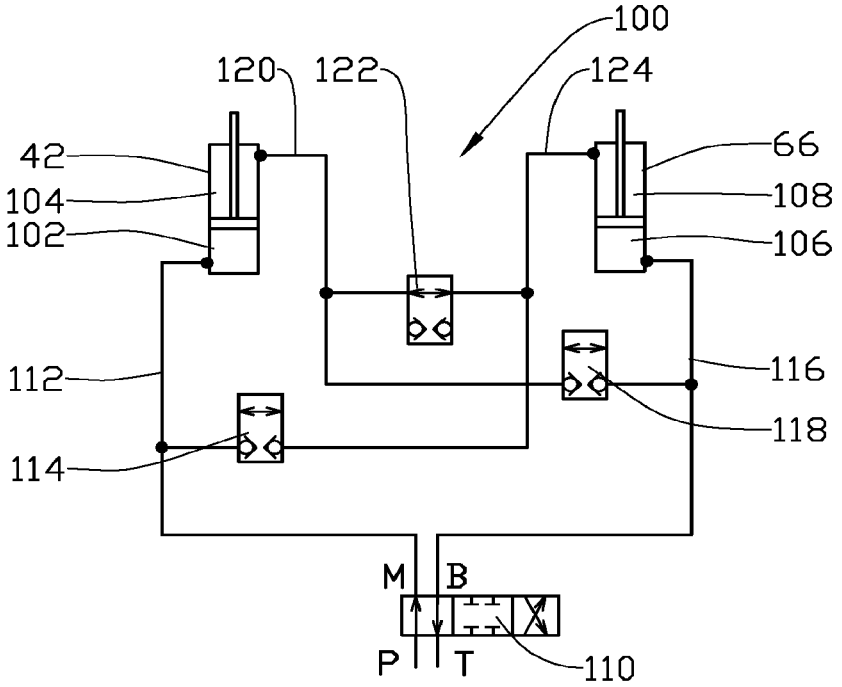
FIG. 8 shows the control circuit in FIG. 7 in normal torque make up mode.

The torque device 1 has two modes of operation: a normal mode and a high torque mode. When making up a tool joint 2 in normal mode, see FIG. 8, the direction valve 110 is activated to flow pressurized hydraulic fluid through the M port and trough the first plus line 112 to the first plus chamber 102 of the first torque actuator 42. The first closable valve 114 is closed. As the first torque actuator 42 is extending, fluid present in the first minus chamber 104 is flowing through the first minus line 120, the third closable valve 122 and the second minus line 124 to the second minus chamber 108. The second closable valve 118 is closed.

The flow from the first minus chamber 104 to the second minus chamber 108 causes the second torque actuator 66 to retract. As the second torque actuator 66 retracts, fluid from the second plus chamber 106 flows via the second plus line 116 to the B port and then to the T port of the direction valve 110.

In one embodiment, se FIG. 7, the pump port P of the direction valve 110 is connected to a pressure regulating valve 126.

Figure 9:
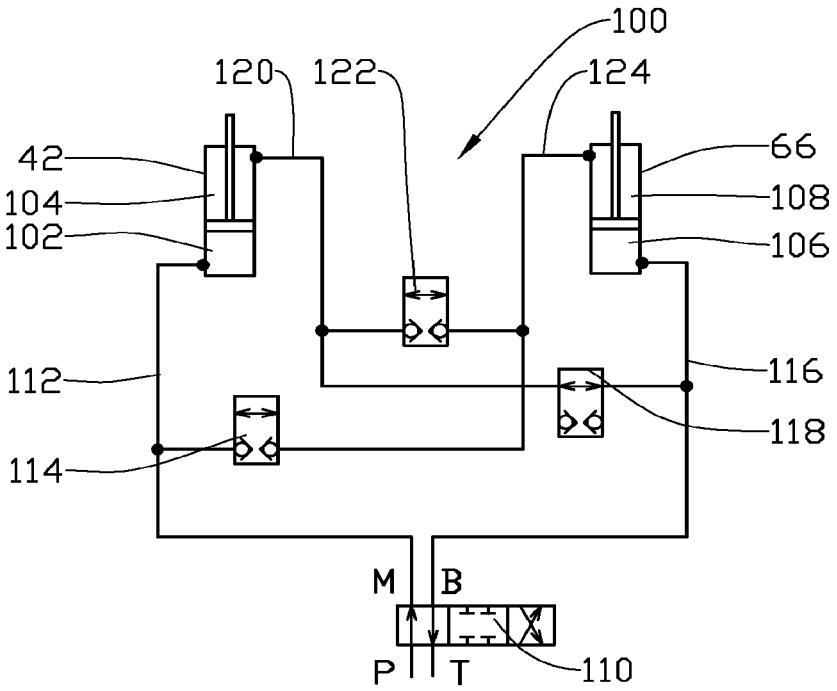
FIG. 9 shows the control circuit in FIG. 7 in high torque make up mode.

When making up a tool joint 2 in high torque mode, see FIG. 9, the direction valve 110 is activated to flow pressurized hydraulic fluid through the M port and trough the first plus line 112 to the first plus chamber 102 of the first torque actuator 42. The first closable valve 114 is closed. As the first torque actuator 42 is extending, fluid present in the first minus chamber 104 is flowing through the first minus line 120, the second closable valve 118 and the second plus line 116 to the B port and then to the T port of the direction valve 110. The first and third closable valves 114 and 122 are closed. No fluid may flow from the second minus chamber 108. The second torque actuator 66 is thus restrained from extending.

The normal and high torque modes when breaking up a tool joint 2 are similar to those explained above for the making up of the tool joint. Such operations may also be utilized for the return idle movement of the torque actuators 42, 66. Table 1 shows the valve positions at different modes of operation.

As explained above, the first torque device 10 is free to slide in the XY plane, while the actuator support 58 may, to a limited extent illustrated by reference numeral 90 in FIG. 6, move freely about the pivot bearing 76. At least a component of this movement is in the X direction, which is in the radial direction relative the operational axis 34.

In order to explain the torque difference between the normal mode and the high torque mode, the operation of make up of the tool joint 2 is chosen. The first and second radial distances 46, 54, see FIG. 1, are of equal length L. Further, at a certain fluid pressure supplied to the first plus chamber 102 the force exerted in the extending direction of the first torque actuator 42 is F.

In normal mode, when the first torque actuator 42 extends, fluid is flowing from the first minus chamber 104 of the first torque actuator 42, and to the second minus chamber 108 of the retracting second torque actuator 66. The force in the two torque actuators 42, 66 are equal but acting in opposite directions in order to keep the actuator support 58, that is freely movable to and from the first torque actuator 42, stationary. The forces from the two torque actuators 42, 66 forms a force couple. The hydraulic pressure is shared by the two torque actuators 42, 66. The resulting forces that are equal but acting in opposite directions are each equal to f.

The resulting force in the first torque actuator 42 is also equal to F-f. As the two torque actuators 43, 66 are equal in dimensions; the force in the first torque actuator 42 is reduced by the same amount that is transferred to the second torque actuator 66. Thus, as F-f=f, the force acting in each torque actuator 42, 66 in normal mode is half that acting in the first torque actuator 42 at high torque mode.

In make up normal mode the torque exerted on the first pipe 4 is the sum of the force from the first torque actuator 42 (f=0.5F) multiplied with the first radial distance 46 (L), and the force from the second torque actuator 66 (f=0.5F) multiplied with the second radial distance 54 (L).

$$0.5F*L+0.5F*L=FL$$

In make up high torque mode the first minus chamber 102 is drained to the T port. The force from the first torque actuator 42 is F. The second torque actuator 66 is restrained from moving and the reaction force in this is also F. Total torque acting on the first pipe 4 in high torque mode is thus $$F*L+F*L=2FL$$

At the same hydraulic fluid pressure, the torque at high torque mode is twice that at normal mode.

The operational "band width" of the torque device 1 is thus increased by utilizing the control circuit 100.

The second torque actuator 66, being restrained from extending during high torque make up, will move the actuator support 58 a distance during the high torque operation.

TABLE 1

| Powered Torque Device Function | Torque Mode | Valve 110 | Valve 114 | Valve 118 | Valve 122 |
|---|---|---|---|---|---|
| Make | normal | Make | closed | closed | open |
| Break | normal | Break | closed | closed | open |
| Make | high | Make | closed | open | closed |
| Break | high | Break | open | closed | closed |

Figure 10:
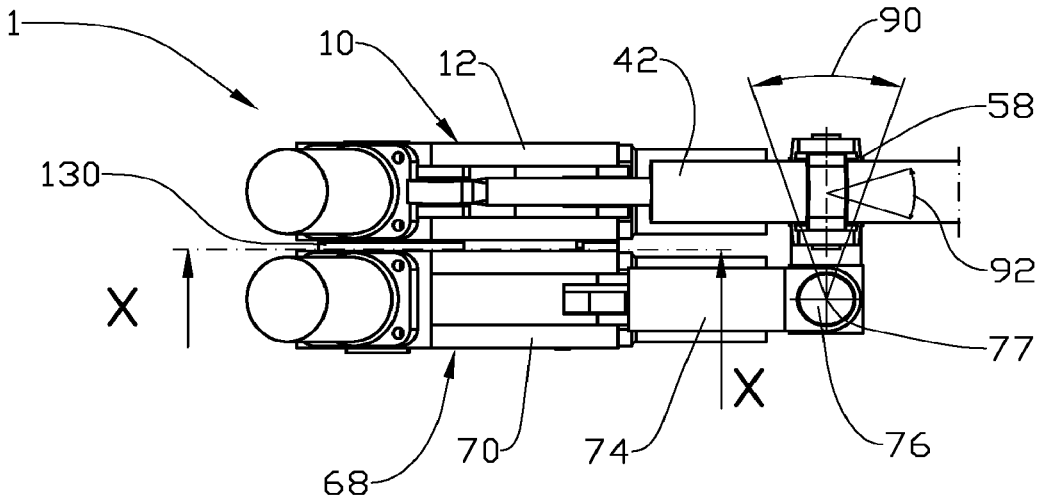
FIG. 10 shows a side view of the torque device.

The torque device 1 is equipped with a guide system 130 for aligning the first torque device member 10 to the second torque device member 68, see FIG. 10. The guide system 130 includes a guide ring 132 that is fixed to one of the first or second torque device members 10, 68. The guide ring 132 is here split into a first guide ring section 134, a second guide ring section 136 and a third guide ring section 138, see FIG. 11. The three guide ring sections 134, 136, 138 are here positioned on and fixed to the upper part 72 of the second torque device member 68.

Figure 12:
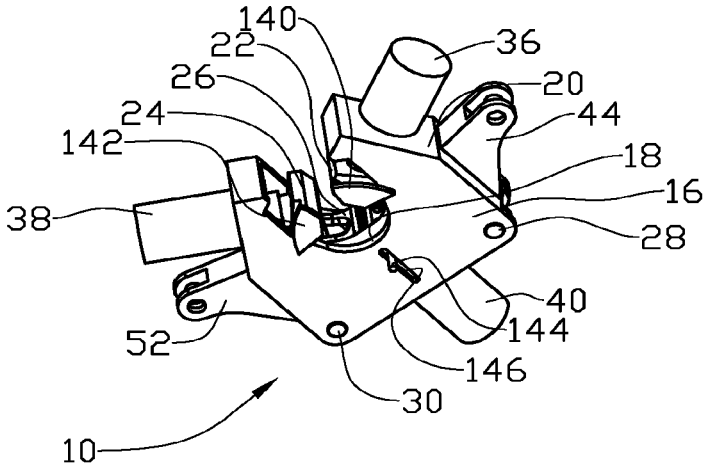
FIG. 12 shows a perspective view from a lower side of the first torque device member.

The guide system 130 also includes a first guide element 140, a second guide element 142 and a third guide element 144 that are movably connected to the other of the first or second torque device members 10, 68, here to the first torque device member 10 and moves with its respective first clamp body 22, second clamp body 24 and third clamp body 26, see FIG. 12. The third guide element 144 extends through an elongate slot 146 in the lower part 16 of the torque device member body 12.

Figure 13:
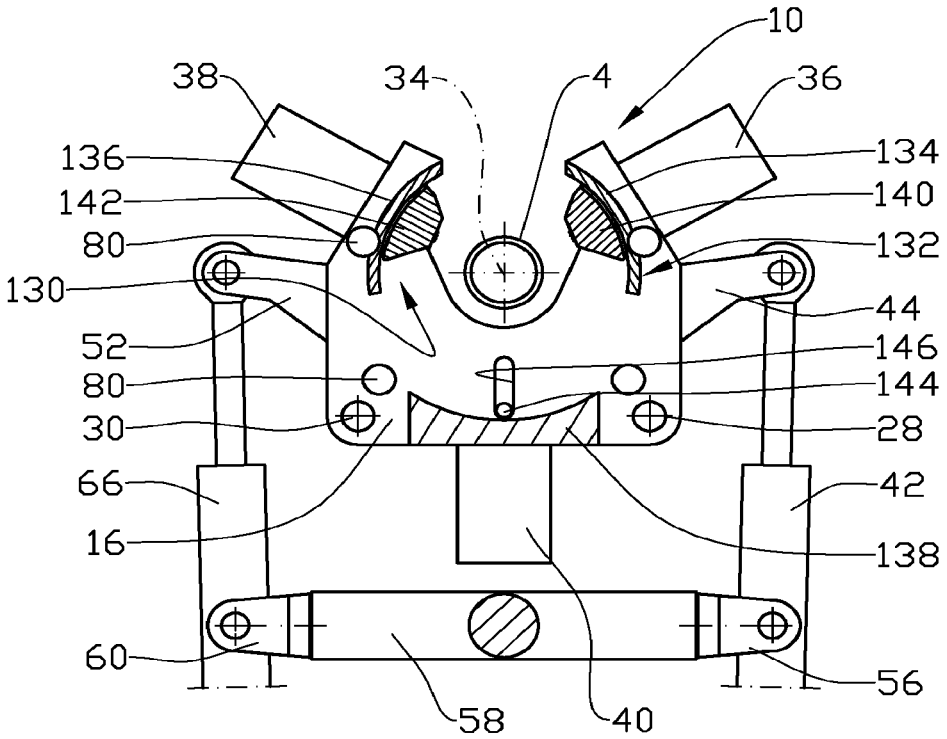
FIG. 13 shows a section X-X in FIG. 10.

In FIG. 13 the clamp bodies 22, 24, 26 are positioned in their retracted positions. The first, second and third guide elements 140, 142, 144, that move with their respective clamp bodies 22, 24, 26, are close to the first guide ring section 134, the second guide ring section 136 and the third guide ring section 138 respectively. The guide elements 140, 142, 144 do not retract sufficiently for simultaneously being in contact with their respective guide ring sections 134, 136, 138. Only two of the guide elements 140, 142, 144 are in contact with their guide ring sections 134, 136, 138 at any time to avoid undue friction forces developing between the guide elements 140, 142, 144 and their respective guide ring sections 134, 136, 138. The centre of rotation, not shown will be approximately at the centre of the guide ring 132.

Figure 14:
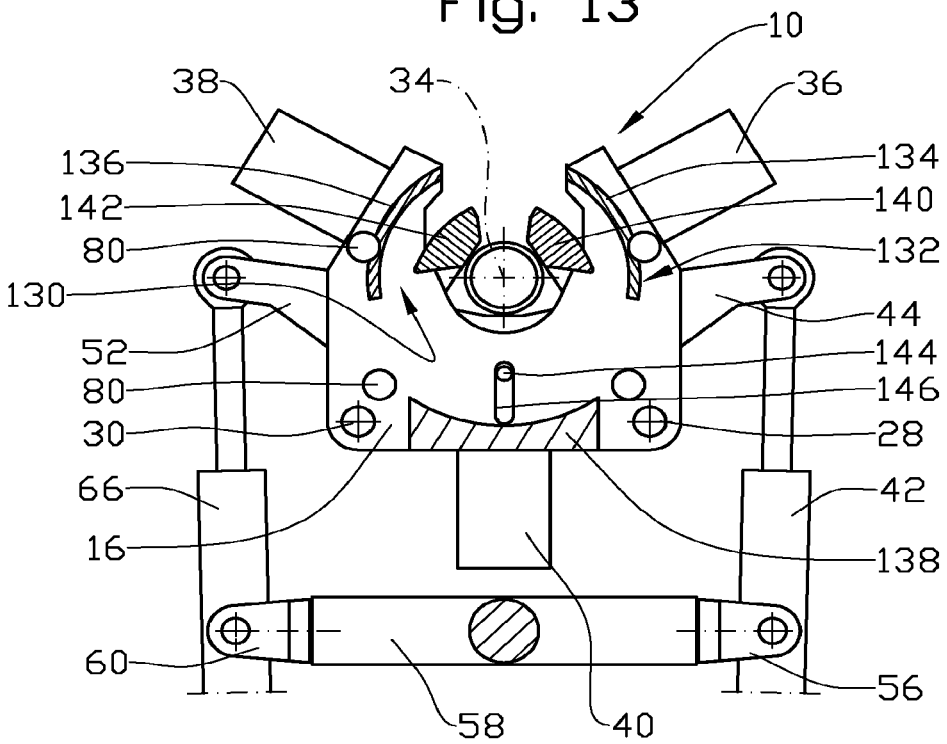
FIG. 14 shows the same as in FIG. 13, but with clamp bodies activated.

In FIG. 14 the clamp bodies 22, 24, 26 are positioned in their active position clamping on the first pipe 4. In this position the guide elements 140, 142, 144 are moved away from the guide ring sections 134, 136, 138. No friction forces may develop in the guide system 130 when the clamp bodies 22, 24, 26 are clamped on and aligned along the operational axis 34.

Figure 15:
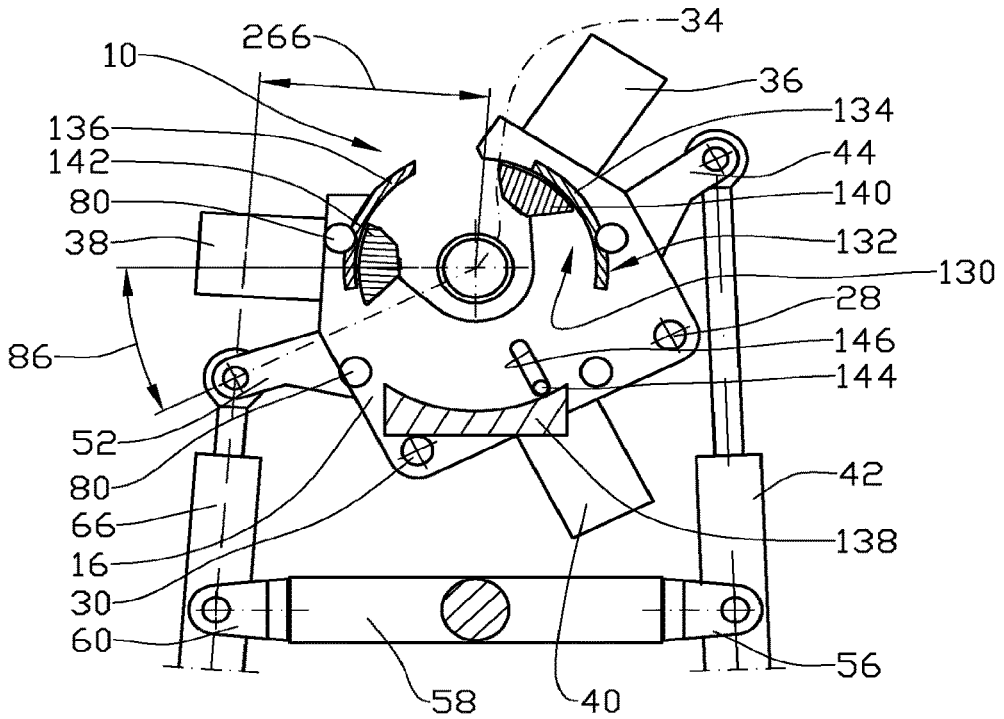
FIG. 15 shows the same as in FIG. 13, but with the first torque device member at a different angle of rotation.

When the clamp bodies 22, 24, 26 are in their retracted position, the guide system 130 will guide the first and second torque device member 10, 68 relative each other during the return stroke of the first and second torque actuators 42, 66 as the rotational position 86 of the first torque device member 10 is altered, see FIG. 15.

Figure 11:
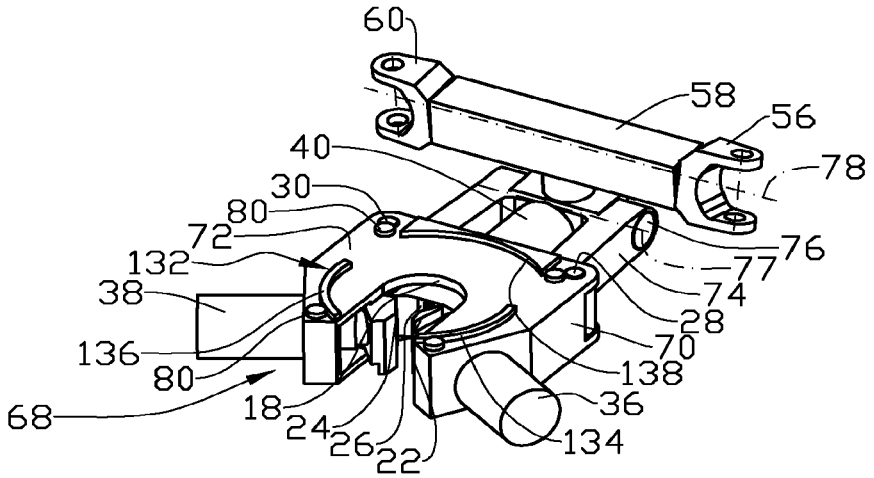
FIG. 11 shows the same as in FIG. 1, but with the first torque device member and the torque actuators removed.

It should be noted that the support pads 80 as well as the first, second and third guide ring sections 134, 136, 138 as shown in FIGS. 13, 14 and 15 are fixed to the second torque device member 68, see FIG. 11, and are not fixed to the first torque device member 10 that is shown in FIGS. 13, 14 and 15.

As the first torque device member 10 is free to slide in the XY plane, the guide system 130 safeguards that the first torque device member 10 is roughly aligned with the second torque device member 68 when the first torque device member 10 is unclamped from the first pipe 4. Still, the guide system 130 is not engaged when the clamp bodies 22, 24, 26 of the first torque device member 10 are in their extended active position.

Figure 16:
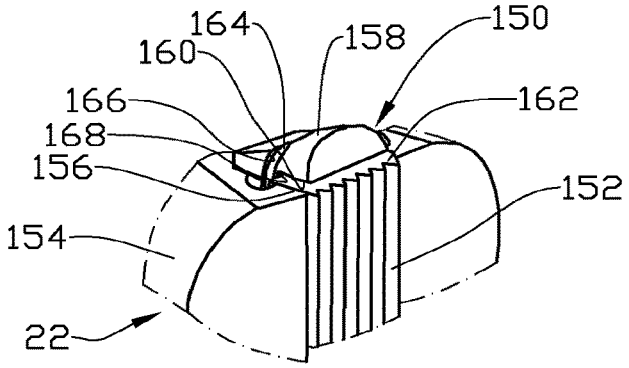
FIG. 16 shows a perspective view of a first clamp body with a compliant die retainer.

A compliant die retainer 150 is shown in FIG. 16. A clamp die 152 is axially, that is in the general Z direction, movably positioned in a clamp fixture 154. A dovetail connection 156 is often utilized for retaining the clamp die 152 to the clamp fixture 154. The clamp fixture 154 is part of the first clamp body 22. The other clamp bodies 24, 26 may also be of the same design.

In FIG. 16 a die retainer 158 in the form of a body has a first surface 160 that is abutting the clamp die 152 at its end surface 162. An elastic body 164 in the form of a band that is positioned in a groove 166 in the die retainer 158 is biasing the die retainer 158 towards the clamp die 152. A second surface 168 prevents the die retainer 158 from moving out of position. There may also be a die retainer 158 at an opposite end portion of the clamp die 152.

Figure 17:
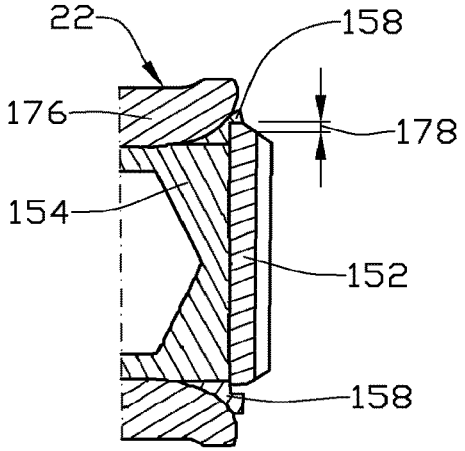
FIG. 17 shows a section of compliant die retainer system in another embodiment.

In FIG. 17 the die retainer 158 is shown in another embodiment where die retainer 158 are positioned at each end of the clamp die 152. The die retainers 158 are here made from resilient material such as rubber or polyurethane. In FIG. 17 the die retainers 158 are positioned between the clamp body 22 and the clamp die 152.

Figure 18:
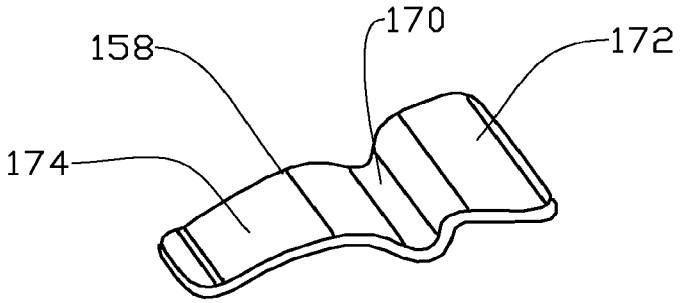
FIG. 18 shows a perspective view of a die retainer.
Figure 19:
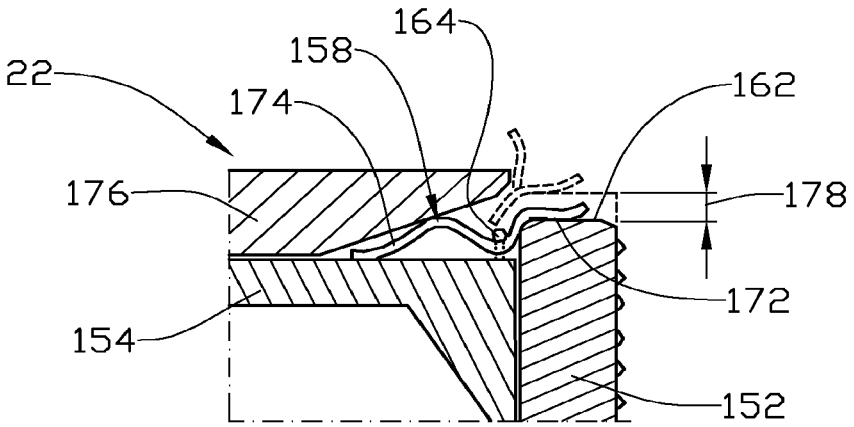
FIG. 19 shows a section with the die retainer in FIG. 18 in a die retainer system in yet another embodiment.

In another embodiment, see FIGS. 18, 19 the die retainer 158 has the form of a formed spring plate. A grove portion 170 is positioned between a first bent portion 172 and a second bent portion 174.

As shown in FIG. 19, the first bent portion 172 abuts the end surface 162 of the clamp die 152 and the second bent portion 174 abuts a hosing 176 of the clamp body 22 as well as the clamp fixture 154.

The die retainer 158 as shown in FIG. 19 is functional in itself, but the elastic body 164 may be positioned in the grove portion 170 to further secure that the die retainer 158 is kept in position.

A not shown end stop may be provided to limit the movement of the clamp die 152 in the clamp fixture 154.

When a force is moving the clamp die 152 in the clamp fixture 154 as shown in FIG. 16, the elastic body 164 is somewhat stretched. When said force is removed, the elastic body 164 returns the clamp die 152 to its initial position.

Similarly, when the clamp die 152 is moved a distance 178, see FIG. 17, the material of the die retainer 158 is compressed. The clamp die 152, when offloaded, is returned to its initial position by the expansion of the die retainer 158.

As a similar movement occurs in the embodiment shown in FIG. 19, the die retainer 158 is bent as indicated by the dashed lines. The clamp die 152 when offloaded, is returned to its initial position by the spring action of the die retainer 158 and the elastic body 164.

Figure 20:
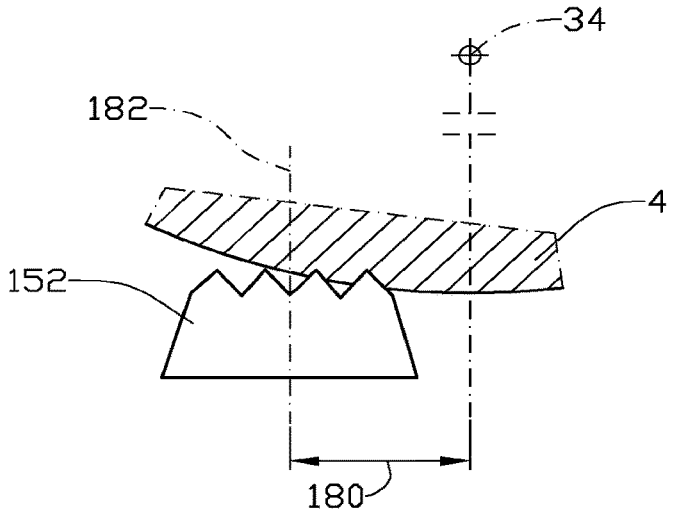
FIG. 20 shows a clamp die in an offset engagement with the first pipe.

In FIG. 20 the clamp die 152 is shown in an engaged, offset position relative the first pipe 4, resulting in a offset distance 180 between a centre line 182 of the clamp die 152 and the operational axis 34 of the first pipe 4.

Figure 21:
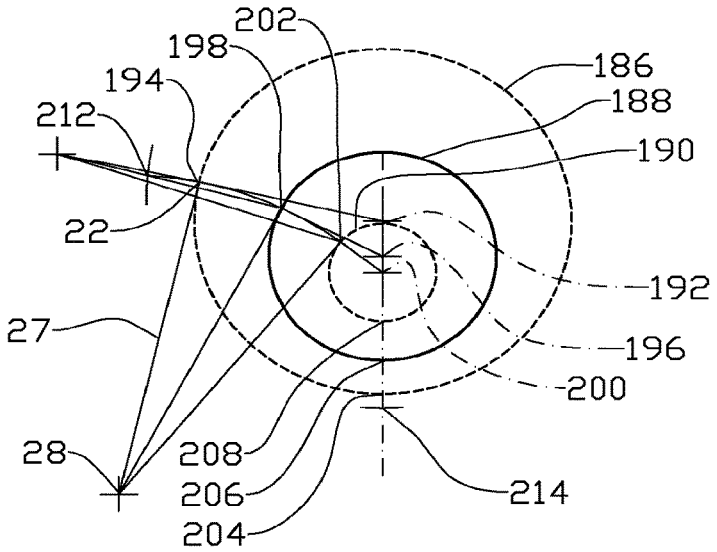
FIG. 21 shows a sketch of a first pipe at different positions relative the first torque device member.

FIG. 21 shows a system sketch where the first clamp body 22 with its clamp arm extension 27 is hinged about the first clamp pin 28 as shown in FIG. 2. The first pipe 4 is shown in three different dimensions as a larger diameter pipe 186, a medium diameter pipe 188 and a smaller diameter pipe 190.

During a clamping operation, the first clamp body 22 and the second clamp body 24, see FIG. 2, moves from opposite sides of the first pipe 4 at equal speeds. The first pipe 4 is thus centred at the centre line 48 regardless of its diameter when clamped. The clamp bodies 22, 24, 26 include the clamp die 152. The positions of the first clamp body 22 shown in FIG. 21 are also applicable for the second clamp body 24.

As the position of the first clamp pin 28 in this embodiment is fixed relative the first torque device member 10, the centre line 182 of the clamp die 152 intersects a larger pipe centre position 192 at a larger pipe tangent position 194, a medium pipe centre position 196 at a medium pipe tangent position 198 and a smaller pipe centre position 200 at a smaller pipe tangent position 202.

The centre positions 192, 198, 200 that are different, correspond with the operational axis 34 for larger diameter pipe 186, the medium diameter pipe 188 and the smaller diameter pipe 190 respectively.

The third clamp body 24, see also FIG. 2, engages the larger diameter pipe 186 at a larger pipe contact position 204, the medium diameter pipe 188 at a medium pipe contact position 206 and the smaller diameter pipe 190 at a smaller pipe contact position 208.

The distance I, II the first and second clamp bodies 22, 24 need to move to achieve alignment of the different pipes 186, 188, 190 are different from the distance III the third clamp body 26 must move. The relationship between the equal distances I, II and the distance III is not linear. However, by using a first order approximation as shown in FIG. 22, the offset distance 180 is reduced substantially; say by a factor of ten compared to a non compensated system.

Figure 22:
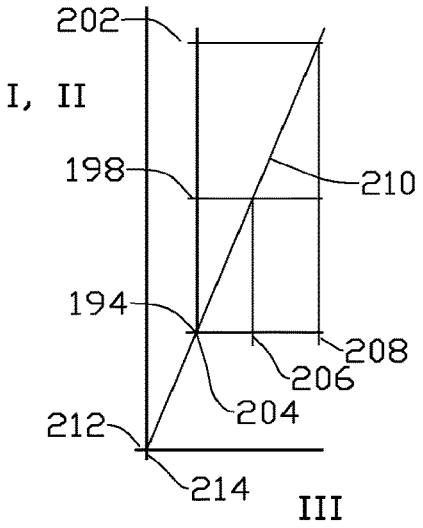
FIG. 22 shows a graph of the ratio of different clamp body travel distances.

In FIG. 22, the travel distance III of the third clamp body 26 is set out along the abscissa, while the corresponding travel equal distances I, II of the first and second clamp bodies 22, 24 are set out along the ordinate. A line 210 shows the relationship between the travel distances I, II versus III. The travel speed of the first and second clamp bodies 22, 24 is adjusted so as they travel a first and second travel distance I, II between the larger pipe tangent position 194 and the smaller pipe tangent position 202 in the same time as the third clamp body 26 travels a third distance III between the larger pipe contact position 204 and the smaller pipe contact position 208.

As the travel speed of the clamp bodies 22, 24, 26 in one embodiment are constant; the retracted positions of the respective clamp bodies 22, 24, 26 are on the line 210 at a first and second retracted position 212 and a third retracted position 214 respectively. The positions 212 and 214 are also indicated in FIG. 21.

Figure 23:
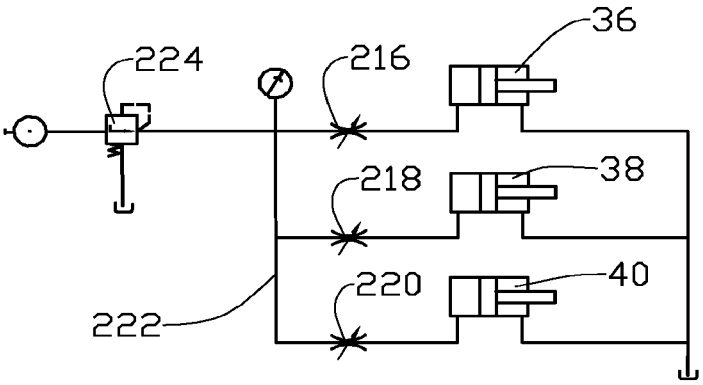
FIG. 23 shows a simplified diagram of speed control.

FIG. 23 shows the basic hydraulic unit to achieve the difference in travel speed of the clamping strokes. The first, second and third clamp actuators 33, 38, 40, here in the form of hydraulic rams, see FIG. 2, are connected to a first flow control valve 216, a second flow control valve 218 and a third flow control valve 220 respectively. The flow control valves 216, 218, 220 are designed to operate over a range of differential pressures. Inside this range, the flow is maintained around a set value. Flow control valves 216, 218 are calibrated to the same flow value, and the third flow control valve 220 is calibrated to a lower flow rate than the first and second flow control valves 216, 218. The ratio between the flow to the third actuator 40 and the flow in the first and second actuators 36, 34 is determined by the geometry of the clamping mechanism and given by the slope and form of the line 210, see FIG. 22. After the flow valves 216, 218, 220 have been adjusted once, they do not need further impending adjustment.

As explained above, the third clamp body 26 has to start at the third retracted position 214 that is closer to the first pipe 4 than the first and second clamp bodies 22, 24 that are at the first and second retracted position 212.

The flow valves 216, 218, 220 are supplied with hydraulic fluid through a supply line 222 that receives fluid through a pressure reducing valve 224. The clamping sequence terminates when no flow is detected through the pressure reducing valve 224. The pressure set at the reduction valve 224 and present after the flow control valves 216, 218, 220 is equivalent to the desired clamp force.

This allows for detection of when flow is still going through the reducing valve 224 and thus to monitor if clamping has finished or not. The first pipe 4 will be clamped also when off-centered relative to the first torque device member 10 because the clamp bodies 22, 24, 26 will continue to move until they all make contact with the first pipe 4. The set pressure has to be above the minimum value that would allow the flow valves 216, 218, 220 to be within the operational range; otherwise, the clamp bodies 22, 24, 26 may move at unpredictable speeds.

Figure 24:
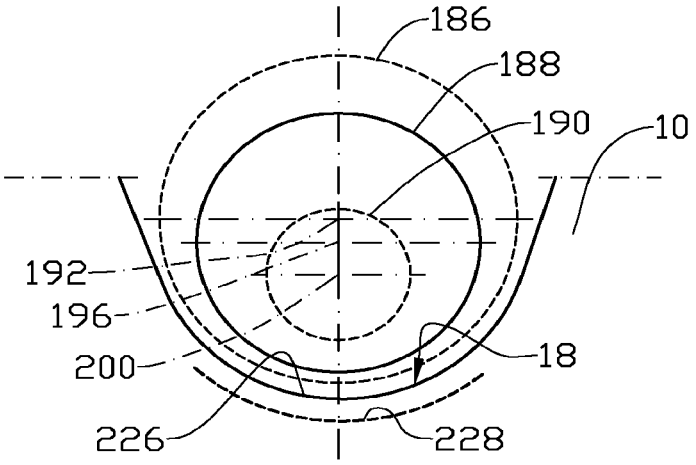
FIG. 24 shows a sketch of resultant positions of different pipes in the first clamp device member as a result of passive compensation.

FIG. 24 shows the result of passive pipe centre compensation using differential clamping stroke speeds. The position of the larger pipe centre 192 is further away from a bottom 226 of the "U" formed slot 18, se also FIGS. 1 and 2, than the medium pipe centre 196. There is thus no need to remove the same amount of material from the bottom 226 of the "U"-formed slot 18 as if the large pipe centre 192 should be positioned in the same position as the medium pipe centre 196. A line 228 indicates the bottom of the "U"-formed slot 18 of an uncompensated system.

The system is applicable to both the first torque device member 10 and the second torque device member 68.

Figure 25:
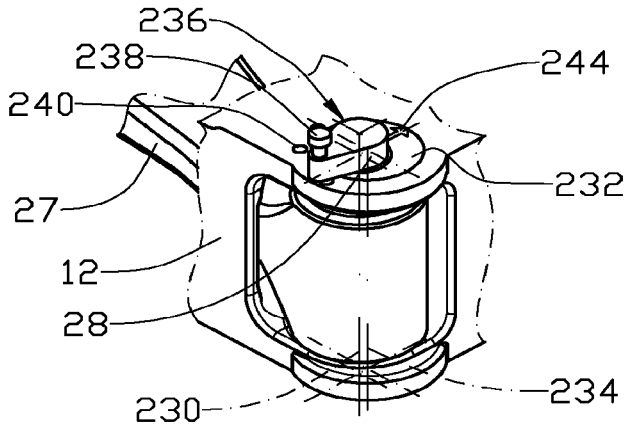
FIG. 25 shows in a larger scale a perspective view of a clamp pin arrangement.

In FIG. 25 an adjustable clamp pin arrangement is shown. In this embodiment the first clamp pin 28, which has a clamp pin axis 230, is coupled to the first torque device member body 12 via turnable bearings 232, here in the form of discs. The bearings 232 have a bearing axis 234 that is eccentric relative the clamp pin axis 230.

In one embodiment the first clamp pin 28 has a lock 236 that includes a lock pin 238. The lock pin 238 may be inserted into any of a number of lock apertures 240 in the first torque device member body 12.

Figure 26:
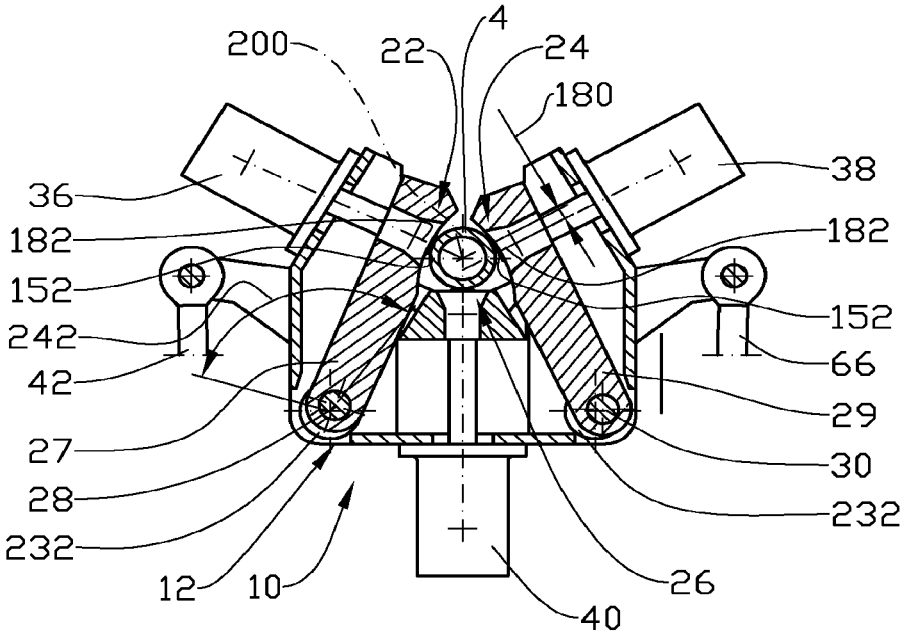
FIG. 26 shows the same as FIG. 2, but with the clamp bodies in an active engaged position.

By turning the clamp pin 28 with the bearings 232 in the first torque device member body 12, the position of the first clamp body 22 relative the first torque device member 10 may be adjusted, see FIG. 26.

In FIG. 26 a first pipe 4 of a diameter corresponding to the smaller diameter pipe 190 in FIGS. 21 and 24 is positioned in the first torque device member 10.

The centre line 182 of the clamp die 152 in the second clamp body 24 has an offset distance 180 relative the small pipe centre position 200 that corresponds with the operational axis 34.

By turning the first clamp pin 28 through an angle 242 as shown on the left hand side of the FIG. 26, the centre line 182 of the clamp 152 in the first clamp body 22 is aligned with the centre 200 of the smaller diameter pipe 190.

An arrow 244 shows the present relative position of the first clamp pin 28.

The system is applicable to both the first torque device member 10 and the second torque device member 68.

In one embodiment shown in FIG. 6, the first torque actuator 42 is equipped with a first position sensor 250 that is designed to give signal that reflects the stroke position of the first torque actuator 42. The second torque actuator 66 is equipped with a second position sensor 252. The actuator support 58 has an actuator support position sensor 254.

In one embodiment a position sensor 255 may be contact less relative the first torque device member 10.

The first torque actuator 42 has a first force sensor 256 that is designed to give a signal that reflects the force exerted by the first torque actuator 42. In an embodiment where the first torque actuator is electrically driven, the first force sensor 256 may be positioned at the first portion 56 of the actuator support 58; alternatively it may measure the power. In an embodiment where the first torque actuator 42 is fluid driven, the first force sensor 256 may be in the form of a fluid pressure sensor. The force may then be calculated.

Similarly the second torque actuator 66 has a second force sensor 258.

In one embodiment the torque may be measured by use of a third force sensor 259 positioned in the actuator support 58.

The sensors 250, 252, 254, 255, 256, 256, 258 and 259 may be of any suitable design as known to a skilled person.

The sensors 250, 252, 254, 256, 256, 258 and 259 are connected to a torque control system 260 by wires 262.

The torque control system 260 is programmed to calculate torque or torque-turn data. The torque-turn data is determined by relating a torque value to the actual turn position of the first torque device member (10). It is thus possible to relate the actual torque exerted on the first pipe 4 by the first torque device member 10 to the actual rotational position 86 of the first torque device member 10.

In one embodiment the torque control system 260 is equipped with memory 264 for storing at least said information.

Figure 27:
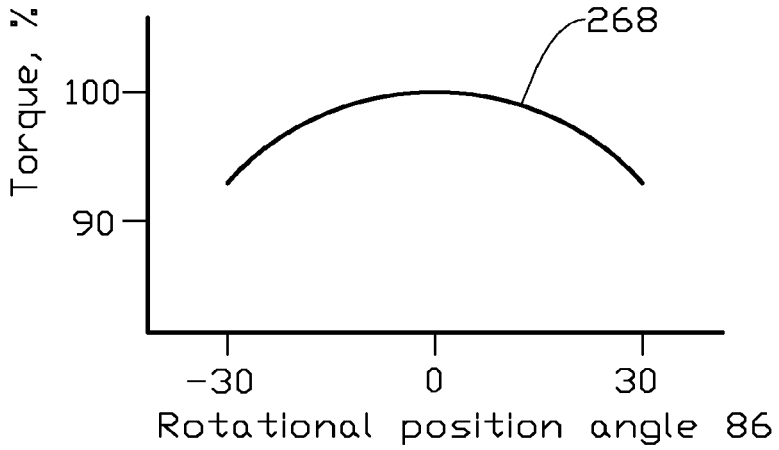
FIG. 27 shows a graph where change in torque is plotted against rotational angle of the torque device.

As the first torque device member 10 alter its rotational position 86, see FIG. 15, the length of a moment arm 266 between the operational axis 34 and a centre line of the first and second actuators 42, 66 alter. The length of the moment arm 266 varies approximately sinusoidal as indicated by a curve 268 in FIG. 27 as the first torque device 10 pivots. In FIG. 27 the abscissa shows the rotational position 86 of the first torque device 10 and the ordinate shows the uncompensated torque in percent. The torque reduction is typically in the region of 7% for a variation of rotational position 86 of ±30 degrees.

This change in moment arm 266 length may be compensated by a change in torque actuator force.

In the case of fluid driven first and second torque actuators 42, 66, the fluid pressure may be adjusted. The adjustable pressure regulating valve 126 of the control circuit 100 for the first and second torque actuators 42, 66 is shown in FIG. 7.

In an embodiment where the first and second torque actuators 42, 66 are electric, the supply current or/and the voltage may be altered as the length of the moment arm 266 changes in order to keep the torque of the first torque device member 10 constant or in line with a preset torque-turn curve.

Figure 28:
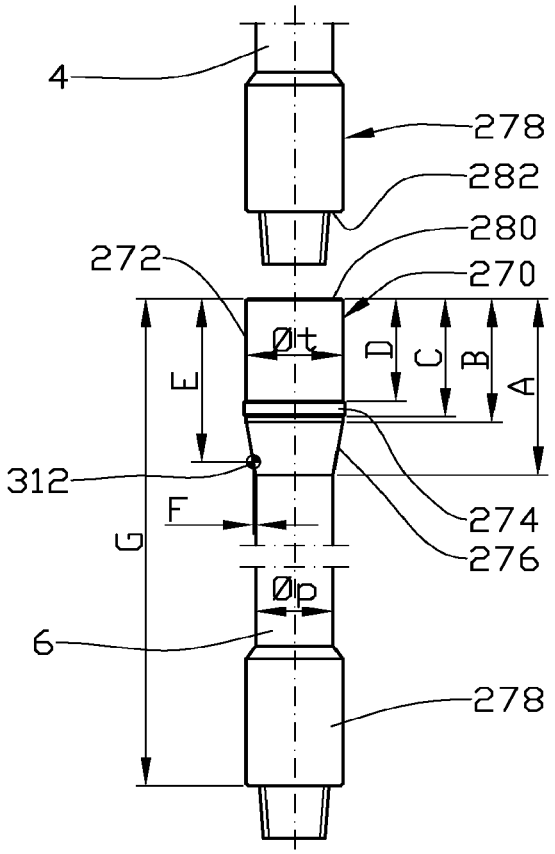
FIG. 28 shows details regarding a first and a second pipe.

A typical box connection 270 of the tool joint 2 is shown in FIG. 28. The box connection 270, which during normal use is positioned at the top of the second pipe 6, has a cylindrical face 272 of diameter Øt with a so called hard band 274 close to the connection upset 276. The first pipe 4 has a pin connection 278 at its lower end. The box connection 270 and the pin connection 278 together form the tool joint 2. The box connection 270 has a box tool joint shoulder 280 and the pin connection 278 has a pin tool joint shoulder 282. At make up of the tool joint 2 the shoulders 280, 282 abut each other.

As the box connection 270 is pipe formed, it is exposed to deformation from the clamp bodies 22, 24, 26 particularly if gripped close to the box tool joint shoulder 280 of the box connection 270, see FIG. 26. Such deformation may mask the torque reading during make up and break out of the tool joint 2.

The second pipe 6 has a pipe diameter Øp while the overall shoulder to shoulder length is G. The box connection 270 has connection upset to box tool joint shoulder distance A and a cylindrical face distance B. Further, the box connection 270 has a base hardband 274 to box tool joint shoulder distance C and a top hardband 274 to box tool joint shoulder distance D.

The hard band 274 has the form of a protruding ring that is made of a relatively hard wearing material. The clamp dies 152 of the torque device 1 should not grip on the hard band 274 as the clamp dies 152 by doing so may be damaged. The clamp dies 152 should preferably grip the box connection 270 as close as possible to the hard band 274 and as far away from the box joint shoulder 280 in order to avoid or reduce the above mentioned deformation. A clamp die 152 is shown in FIG. 20.

Figure 29:
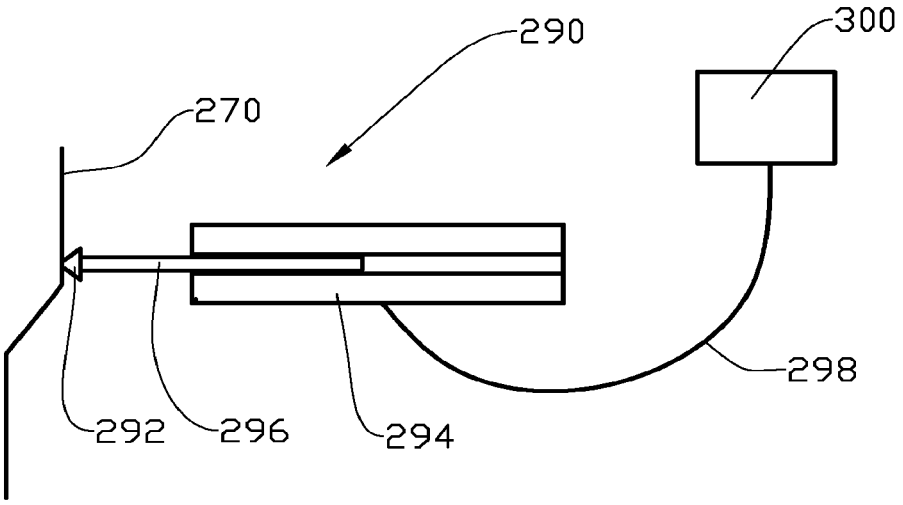
FIG. 29 shows a principle drawing of a tool joint finder.

FIG. 29 shows an apparatus, here termed Tool Joint Finder (TJF) 290 for reading the relative surface position of the pipes 4, 6. The TJF 290 includes a sensor tip 292 that is connected to a linear sensor 294 via a guide 296 in the form of a measuring rod. A signal from the linear sensor 294 is transmitted via a cable 298 to a measuring control system 300 that is programmed to at least transform the signal from the linear sensor 294 into a readable graph 302 shown in FIG. 30.

Figure 30:
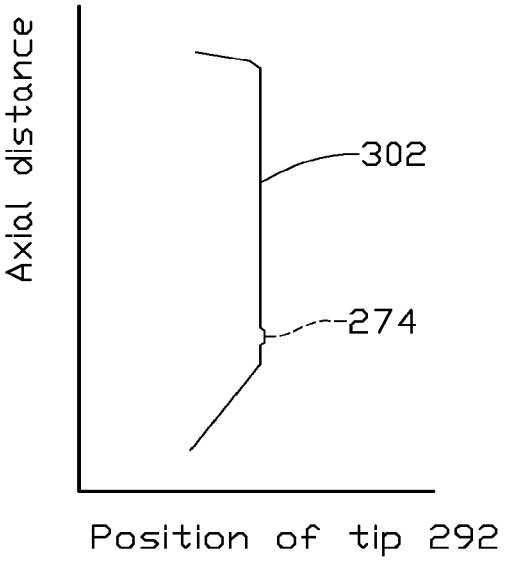
FIG. 30 shows a graph where a tip position is plotted against axial distance.

In FIG. 30, that shows a measured profile of the box connection 270 in FIG. 28, the abscissa shows the position of the sensor tip 292 while the axial distance of the box connection 270 is plotted along the ordinate. The contour of the hard band 274 is clearly visible on a curve 302.

Figure 31:
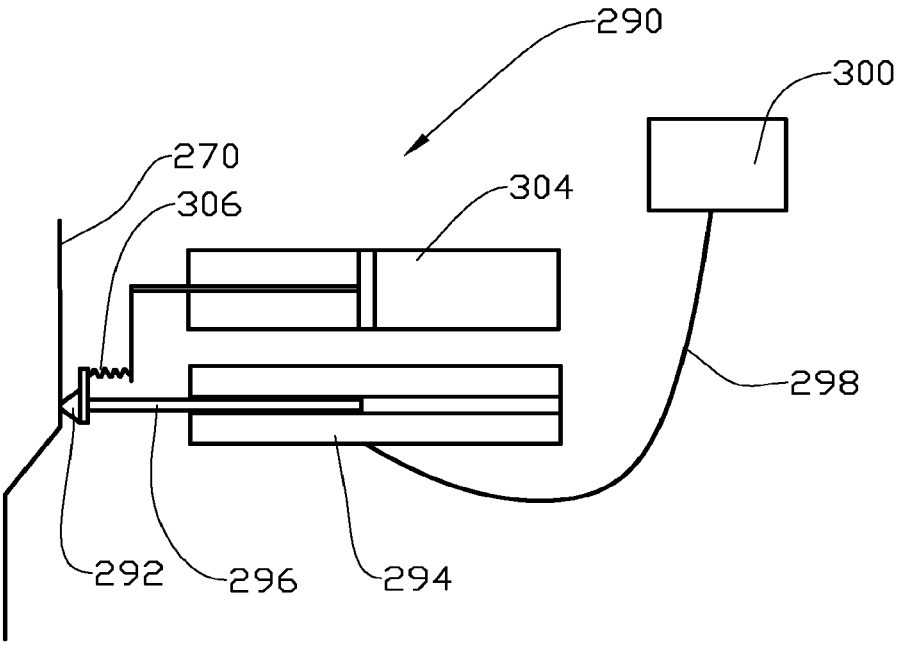
FIG. 31 shows a principle drawing of a tool joint finder in another embodiment.

The sensor tip 292 is in one embodiment biased against the first pipe 6 by a tip actuator 304, here in the form of a fluid driven ram. The tip actuator 304 may in one embodiment be connected to the measuring tip 222 via a tip spring 306 as shown in FIG. 31. When activating the TJF 290, the tip actuator 304 moves the tip spring 306 to a predetermined position or a position determined by help of the linear sensor 294. The radial movement of the sensor tip 292 relative the box connection 270 during the measuring operation is taken up by the tip spring 306.

Figure 32:
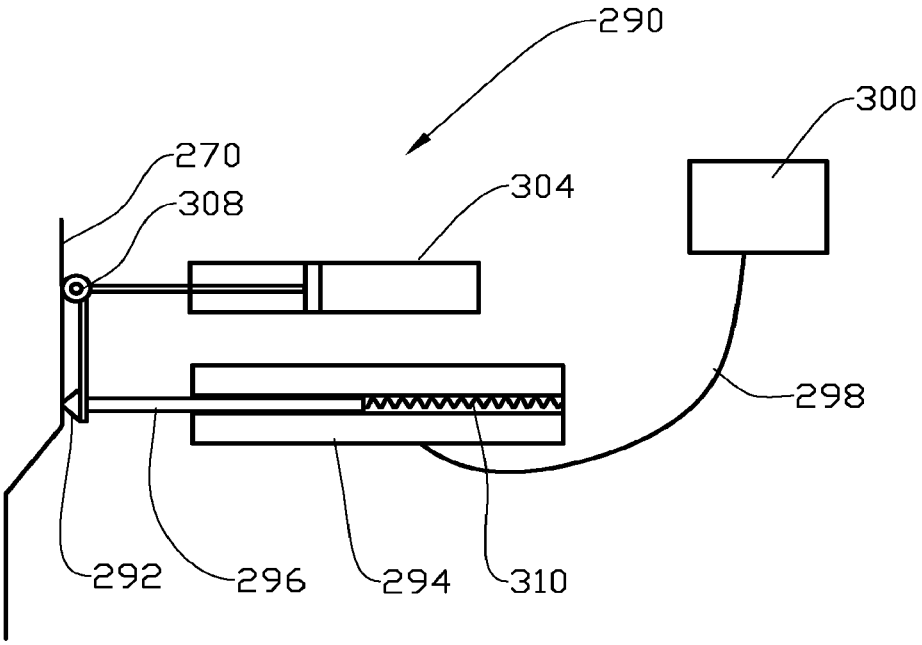
FIG. 32 shows a principle drawing of a tool joint finder in yet another embodiment.

In one embodiment as shown in FIG. 32 the tip actuator 304 is pushing against the box connection 270 of the first pipe 4 preferably with a constant force. If an external force exceeds the force from the tip actuator 304, the tip actuator 304 will yield.

In FIG. 32 the sensor tip 292 is shown connected to the tip actuator 304 by a hinge 308 that allows the sensor tip 292 to locally move back and forth.

A sensor spring 310 in the linear sensor 294 is biasing the guide 296 towards the sensor tip 292 with a relatively small force. The linear sensor 294 is thus only marginally influenced by the movement of the tip actuator 304.

The TJF 290 is in one embodiment positioned on one of the torque device members 10, 68 of the torque device 1. As the torque device 1 is vertically moved relative the tool joint 2, the TJF 290 will read the surface of at least a part of the first or second pipes 4, 6. The position of the hard band 274 of the box connection 270 is determined and the clamp dies 152 of the second torque device member 68 positioned as close to the hard band 274 as desirable.

A datum point 312 may be chosen on the box joint shoulder 280 in order to overcome some reference drawbacks of certain TJF 290.

Figure 33:
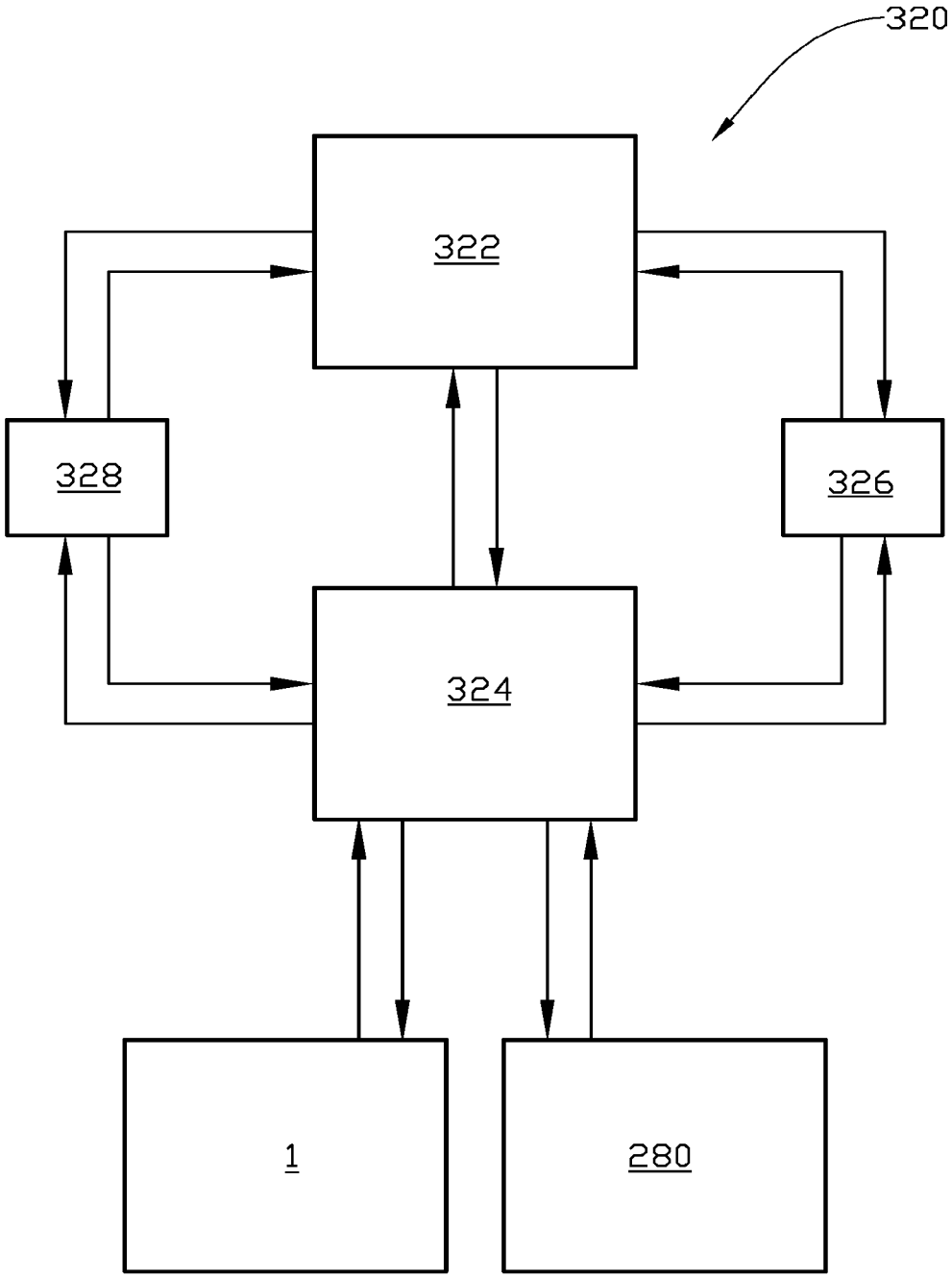
FIG. 33 shows a block diagram related to a pipe tally system.

A pipe tally system 320, as known from oilfield use, includes a database 322, see FIG. 33, typically in the form of an electronic database. The tally system 320 often includes such information as the identity of pipes, here exemplified by the first and second pipes 4, 6, the so-called shoulder to shoulder length G and the weight of each of the pipes 4, 6.

As the identity of the pipes 4, 6 are identified when built into a string, not shown, the length and weight of said string may be updated by the prior art tally system as new pipes are added.

The torque device 1 and the TJF 290 may have separate or a common control system 324 that in one embodiment at least includes one of the torque control system 260, or the measuring control system 300.

The control system 324 is connected to the torque device 1 and the TJF 290. Such connections include necessary not shown power cables or hydraulic lines as well as control cables.

Pipes 4, 6 and tool joint 2 data stored in the tally system that in one embodiment are utilized by the torque device 1 and profile sensing/mapping tool joint finder (TJF) 290 could include, but not be limited to, the following:

General Data:

Pipe 4,6 identity

Box connection 270 identity

Pin connection 278 identity

Pipe/connection type

Hardbanding yes/no/type

Calibration factor(s)

Dimensional data for pipe 4, 6 and tool tool joint 2:

Dimensions may be generic for pipe type and/or specific to actual pipe/tool joints in current condition as tool joints may be re-machined, hardbanding re-applied etc. Tool joint dimensions can be for box connection and pin connection as required.

G—overall shoulder to shoulder length

Øt—diameter tool joint

Øp—diameter pipe

A—upset to shoulder distance

B—cylindrical face distance

C—base of hardbanding to shoulder

D—top hardbanding to shoulder

Derived dimensions that may be calculated in the torque device 1/TJF 290 control system 324:

$$\text{Width hardbanding}=C-D$$

$$\text{Upset slope}=(Øt-Øp)/(A-B)$$

$$E=\text{Datum distance for the TJF290}=A-(\text{Register offset*upset slope})$$

Register offset: As certain tool joint finders may have a "deadband" F distance within which profile changes will not be registered, a register offset is thus associated with that particular TJF 290. This and any other torque device 1 or TJF 290 specific information would likely but stored in, or input into the torque device 1 or TJF 290 control system 324 rather than in the tally database 322.

Torque data to be stored in the database 322:

Torque operation date and time tagged.

Well data as required.

Maximum, minimum and recommended make-up torque values for the tool joints 2. These may be stored in tally database 322 and output to torque device 1 control system 324 or be directly input by operator 326 to control system 324.

Target torque from operator 326 input may be stored in the torque device 1 control system 324 or in tally database 322.

Generally, inputs may be supplied by an operator 326 or read from an available source such as a radio frequency identification (RFID) reader 328 placed at the torque device 1 or at the TJF 290.

The control system 322 receives information of actual torque and related rotational position 86 of the first torque device member 10 as mentioned above. Measured torque-turn information is in one embodiment stored in the tally database 320 and related to the actual tool joint 2.

Data from measurements that may be stored in the tally database 320:

Actual make-up torque that are registered by the torque control system 260 and output to a historical tool joint database that may be part of the tally database 322 or could be a separate database not shown.

Expected or optimal break-out torque may be stored as an absolute value or as a derived function of actual make-up torque.

Actual break-out torque as registered by the torque control system 260 and output to the historical connection database. Optimal torque/turn curves may be stored in tally system database if the associated torque device 1 is torque/turn capable.

Actual torque/turn curves may be stored in tally historical database.

Out of range warnings may be logged.

Pipe profile data to be stored in the database 322:

Measurement operation date.

Generic and joint specific dimensional information as listed above.

Measured dimensional information as listed above from the TJF 290.

Based on available information to the control system 324, the control system may in one embodiment produce outputs to the operator 326. The output may include: actual torque compared with baseline torque, warnings, tong status, TJF 290 output and tool joint diagnosis.

Actual torque turn curves may be processed within tong control system in real time and out of range warnings given.

Tally historical database information may be output to and utilized by a maintenance planning system.

Additional benefits and possible uses of the integration of torque-turn and profile information in the pipe tally system 320 are discussed in the general part of the description.

What is claimed is:

1. A torque device for guiding a first torque device member relative to a second torque device member, the torque device comprising the first and second torque device members, each of the torque device members having an operational axis of rotation and three clamp bodies spaced about the operational axis, wherein the clamp bodies are movable between a retracted passive position and an extended active position, the torque device further comprising:

a guide ring on one of the torque device members, the guide ring comprising one or more guide ring sections; and at least two guide elements on the other of the torque device members, each guide element being movable with one of the clamp bodies of the respective torque device member, wherein when the clamp bodies of the respective torque device member are in their retracted positions, the guide elements abut or are close to the guide ring, wherein when the clamp bodies of the respective torque device member are in their extended positions, the guide elements are moved away from the guide ring.

2. The torque device of claim 1, wherein the guide ring only makes part of a full circle.

3. The torque device of claim 1, wherein when all clamp bodies are at their fully retracted position, at least one of the guide elements has a clearance to the guide ring.

4. The torque device of claim 1, wherein the guide ring protrudes from the lower part of the first torque device member.

5. The torque device of claim 1, wherein the guide ring protrudes from the upper part of the second torque device member.

6. The torque device of claim 1, wherein the guide ring is an integral part of the lower part of the first torque device member.

7. The torque device of claim 1, wherein the guide ring is an integral part of the upper part of the second torque device member.

8. The torque device of claim 1, wherein at least one of the first, second or third guide element protrudes through an elongate slot.

9. A method of guiding a first torque device member of a torque device relative to a second torque device member of the torque device, each of the torque device members having an operational axis of rotation and three clamp bodies spaced about the operational axis, wherein the clamp bodies are movable between a retracted passive position and an extended active position wherein the method comprises:

coupling a guide element to each of at least two of the clamp bodies of one of the device members;

coupling a guide ring to the other device member; and abutting the guide elements with, or positioning the guide elements close to, the guide ring when the clamp bodies, to which the guide elements are coupled, are in their retracted positions, wherein the method further includes the step of:

moving the guide elements away from the guide ring when the clamp bodies are moved to their ex-tended positions.

10. The method of claim 9, wherein the method further includes: letting the guide ring comprise guide ring sections.

11. The method of claim 9, wherein the method further includes: letting the guide ring only makes part of a full circle.

12. The method of claim 9, wherein the method further includes: letting at least one of the guide elements have a clearance to the guide ring when all clamp bodies are at their fully retracted position.

13. The method of claim 9, wherein the method further includes: letting the guide ring protrude from the lower part of the first torque device member.

14. The method of claim 9, wherein the method further includes: letting the guide ring protrude from the upper part of the second torque device member.

15. The method of claim 9, wherein the method further includes: letting the guide ring be an integral part of the lower part of the first torque device member.

16. The method of claim 9, wherein the method further includes: letting the guide ring be an integral part of the upper part of the second torque device member.

17. The method of claim 9, wherein the method further includes: letting at least one of the first, second or third guide element protrude through an elongate slot.

* * * * *